US006959095B2

(12) United States Patent
Bakis et al.

(10) Patent No.: US 6,959,095 B2
(45) Date of Patent: Oct. 25, 2005

(54) METHOD AND APPARATUS FOR PROVIDING MULTIPLE OUTPUT CHANNELS IN A MICROPHONE

(75) Inventors: Raimo Bakis, Briarcliff Manor, NY (US); Mark E. Epstein, Katonah, NY (US)

(73) Assignee: International Business Machines Corporation, Armonk, NY (US)

( * ) Notice: Subject to any disclaimer, the term of this patent is extended or adjusted under 35 U.S.C. 154(b) by 791 days.

(21) Appl. No.: 09/927,690

(22) Filed: Aug. 10, 2001

(65) Prior Publication Data

US 2003/0031327 A1 Feb. 13, 2003

(51) Int. Cl.[7] ..... H04R 3/00
(52) U.S. Cl. ..... 381/122; 704/231
(58) Field of Search ..... 381/26, 92, 122, 381/17–23; 348/14.01; 379/202.01, 206.01; 704/231

(56) References Cited

U.S. PATENT DOCUMENTS 4,658,425 A 4/1987 Julstrom
5,323,257 A * 6/1994 Abe et al. ..... 381/172
5,335,011 A * 8/1994 Addeo et al. ..... 348/14.1
5,625,697 A 4/1997 Bowen et al.
5,686,957 A 11/1997 Baker
5,828,997 A * 10/1998 Durlach et al. ..... 704/233
6,009,396 A 12/1999 Nagata
6,069,961 A 5/2000 Nakazawa
6,069,963 A 5/2000 Martin et al.
6,094,242 A 7/2000 Yamanaka
6,137,887 A 10/2000 Anderson
6,173,059 B1 1/2001 Huang et al.

* cited by examiner

*Primary Examiner*—Brian T. Pendleton
(74) *Attorney, Agent, or Firm*—Scully, Scott, Murphy & Presser; Richard M. Ludwin

(57) ABSTRACT

Methods and apparatus for providing multiple output channels in a microphone. More particularly, provision is made for an arrangement wherein a single microphone is adapted to produce one or more different audio outputs depending upon characteristics of a speaker or user of the microphone while facilitating a high degree of accuracy in the recognition of the user or speaker by the arrangement. The microphone is adapted to produce one or more different audio streams or outputs depending upon the speaker presently using the microphone. In effect, this can be readily implemented by a main user or speaker, such as an interviewer on a radio or TV talk show, or any speaker in a conference room, intending to control the audio output streams by suitably activating a button or switch.

30 Claims, 1 Drawing Sheet

METHOD AND APPARATUS FOR PROVIDING MULTIPLE OUTPUT CHANNELS IN A MICROPHONE

BACKGROUND OF THE INVENTION

1. Field of the Invention

Figure 1:
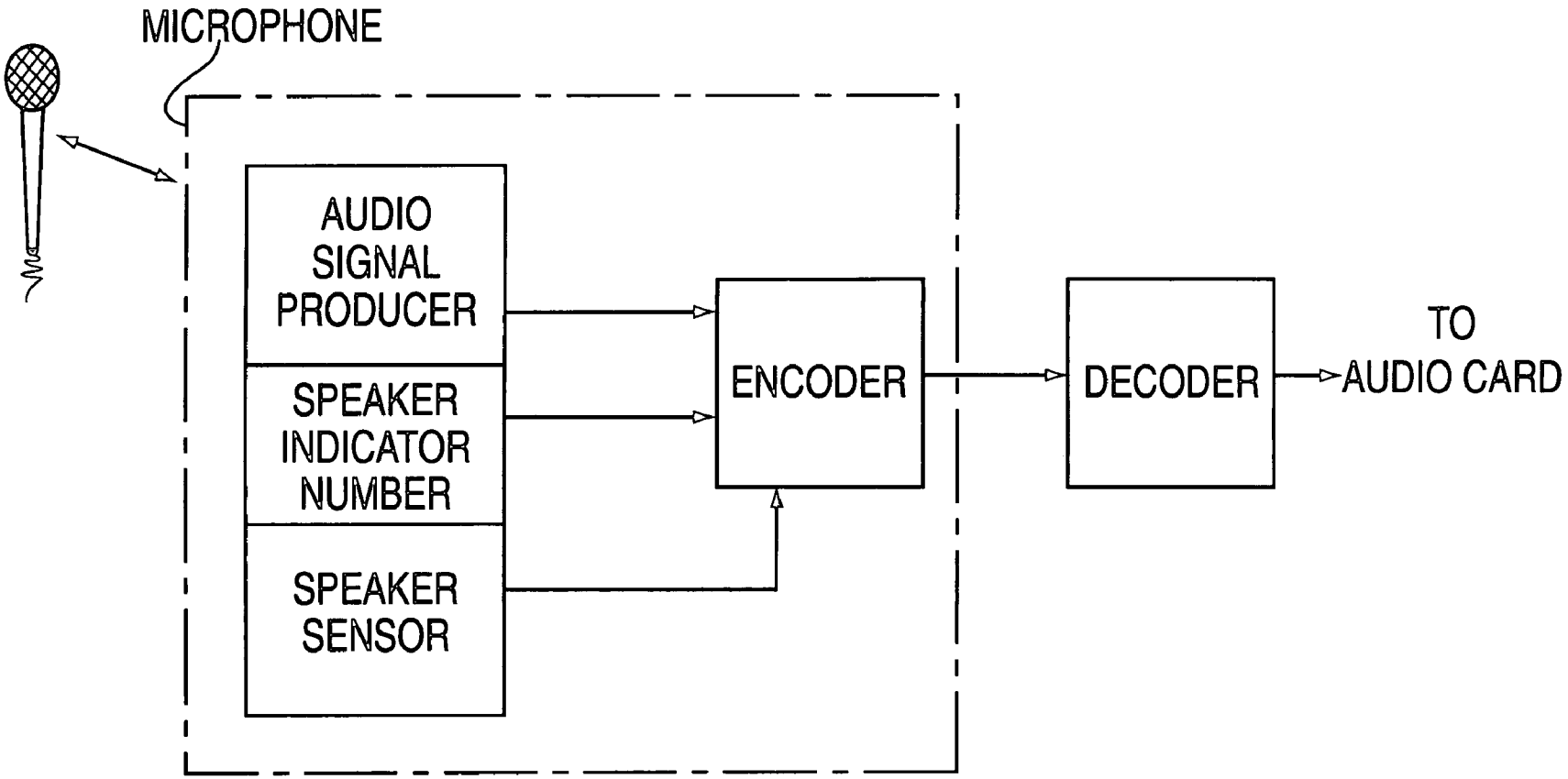

The present invention relates to methods and apparatus for providing multiple output channels in a microphone. More particularly, the invention is concerned with the provision of an arrangement wherein a single microphone is adapted to produce one or more different audio outputs depending upon characteristics of a speaker or user of the microphone while facilitating a high degree of accuracy in the recognition of the user or speaker by the arrangement.

Currently, in the technology wherein one or more speakers utilize a plurality of microphones at generally the same time, difficulties are encountered in being able to prioritize the particular microphone which is to be employed; in effect, actuated at any particular instance, or to be able to clearly distinguish or identify which speaker is utilizing any particular microphone at a specified point-in-time. Basically, the technology utilizes either an array of microphones which is designed to pick-up multiple speakers located within a predetermined confined space or room; for example, a conference room or auditorium, utilizing the microphone array in order to detect which particular speaker is most likely to be adapted to improve signal-to-noise ratio encountered within the specified room or confined space; or utilizing a microphone array in order to connect to a video system so as to track a speaker, especially during teleconferencing.

2. Discussion of the Prior Art

Numerous patent publications are in existence which, in general, relate to the deployment of arrays of operatively associated microphones in order to be able to identify or recognize different speakers and/or prioritize the use of select microphones of the microphone arrays.

Huang et al. U.S. Pat. No. 6,173,059 B1 discloses a telephone system employing two or more microphones which are retained together and directed so as to face outwardly from a central point. Through the use of mixing circuitry, and controlled circuitry signals are combined and analyzed when received from the telephones, and the signal from one of the microphones, or from one or more predetermined combinations of microphone signals, are employed in order to track a speaker as the speaker moves about a room or various speakers situated about the room speak and then fall silent.

Anderson U.S. Pat. No. 6,137,887 discloses a directional microphone system in which multiple microphone units are activated by a control system depending upon a speaker having his speech originate within a specified acceptance angle which is located in front of the microphones. This automatically identifies the microphone which provides for the best reception of the speaker, and in one instance only turns on one microphone for each speaker, and in other instances also allowing several microphones to turn on simultaneously for several talkers at predetermined points-in-time.

Martin et al. U.S. Pat. No. 6,069,963 discloses a hearing aid having a multidirectional sensitivity based on the use of microphones positioned on the hearing aid, thereby enabling sounds to be received and determined at differences in sound transit time within a sound channel.

Nakazawa U.S. Pat. No. 6,069,961 discloses a system utilizing multiple microphones which are adapted to detect the direction of a sound source and extracting therefrom an object sound with a high signal/noise ratio at an excellent degree of accuracy.

Nagata U.S. Pat. No. 6,009,396 discloses a method and system for microphone array input which provides for speech type recognition using band-pass power distribution for sound source position and direction estimation.

Baker U.S. Pat. No. 5,686,957 pertains to a teleconferencing imaging system including automatic camera steering relative to the reception of sounds by a plurality of microphones in an array connected to a voice-directional camera imaging system, the latter of which electronically selects segmented images from a selected panoramic video screen arranged around a conference table.

Bowen et al. U.S. Pat. No. 5,625,697 discloses a microphone selection process for use in a multiple microphone voice actuating switching system, whereby, predicated on different qualities of speech signals as received in a plurality of microphones, this will enable the selection of the best received speech signals within the environment of a conference room.

Addeo et al. U.S. Pat. No. 5,335,011 discloses a sound localization system for teleconferencing by employing self-steering microphone arrays, wherein a signal selection is implemented for the best video and sound image emanating from a virtual location on a displayed image.

Julstrom U.S. Pat. No. 4,658,425 discloses a microphone actuating control system suitable for teleconference systems, wherein a selection is employed in conjunction with the different modulated signals indicating that an associated microphone of an array of microphone is the source of the first loudest microphone signal.

Finally, McDonnell et al. U.S. Pat. No. 4,396,800 discloses a microphone switching device wherein a switch is positioned on a microphone handle so as to enable audio signals to be transferred by a user of the microphone from one location to a different location, particularly when the microphone is used on a soundstage or public address system. However, there is no disclosure of an encoding and decoding arrangement being incorporated into the microphone, as is the case of the present invention.

In the technology, none of these systems and arrangements of multiple phones, with the exception of the use of a switch to activate a signal as is disclosed in the microphone of McDonnell et al. U.S. Pat. No. 4,396,800, provide for a single microphone enabling the utilization of multiple output channels for preferred utilized voice recognition.

SUMMARY OF THE INVENTION

In essence, the present invention provides for a method and arrangement in creating a microphone adapted to produce one or more different audio streams or outputs depending upon the speaker presently using the microphone. In effect, this can be readily implemented by a main user or speaker, such as an interviewer on a radio or TV talk show, or any speaker in a conference room, intending to control the audio output streams by suitably activating a button or switch. This can be readily constituted of a mercury balance switch which is located in the microphone and is adapted to detect a microphone angle or orientation, or and alternatively, can be implemented by introducing or adding multiple microphone pick-up elements in the head of the microphone so as to enable energy/volume levels to be employed in order to detect the identity of the user or speaker.

Moreover, the microphone can be provided with a set of LEDs to provide visual feedback to the speakers indicating as to which particular channel is active. Also the output of any channel number of; for example 1 to N, can be encoded by utilizing multiple output wires, by adding a DC bias, or using modulation on different carrier frequencies.

In a physical application, it is possible to contemplate a speaker talking with or an interviewer interviewing another person, or persons, wherein the conversation is to be concurrently and practically instantaneously translated into a plurality of different languages, and then to have the resulting output audio in each language synchronized back to a video.

Consequently, it is imperative that high quality speech recognition be obtained as rapidly as possible. The speaker or interviewer, who is normally the primary user of the microphone, is ordinarily a good speaker who could be well trained in a speech recognition system, whereas in contrast therewith the person being addressed or interviewed (interviewee) will not be likely well trained, so one would require a more general statistical model for speech recognition. Moreover, the words and grammatical usage of the interviewer and the interviewee (or interviewees) are likely to be quite different, and consequently it would be advantageous to provide a different speech recognizer for the interviewer or interviewee. Although there are basically two ways to implement the foregoing, such as in either hardware or software, primarily the technology has heretofore focused on software solutions to this problem, in an area of the technology currently referred to as "speaker identification".

In essence, "speaker identification" which is utilized in connection with software is subject to two problems. Firstly, the speaker identification introduces a time delay, whereby at any time the interviewee might to wish to interject some comments and the interviewer would then "pass the microphone" to the interviewee. Consequently the speaker I.D. have to be continuously implemented, introducing a several second delay in time. Secondly, the speaker identification or I.D. is subject to mistakes, especially if the interview takes place in a noisy or poor sound transmissive environment.

To the contrary, in comparison with the use of software, employing a hardware solution is a much more rapid and reliable solution to the above-mentioned problems. There are two approaches, in which a first approach requires the interviewer to manually control the output of the microphone, either by pressing a button, switch or some other tactile device, or by adjusting the angle or orientation of the microphone to thereby automatically change the output. Another approach would be to install multiple pick-up elements in the head of the microphone, to additionally use energy pick-up elements in the head of the microphone, and to also use an energy-volume-direction information of an input signal in order to determine whether the speaker is or is not the person holding the microphone. A still further even more advanced solution could be employed in order to detect frequency vibrations produced in the hand of the user of the microphone during periods of speech indicating that the interviewer is the person speaking. Thereafter, the outputted microphone can be adjusted to identify the person speaking, and this can be implemented in a single channel by adding a DC bias or by modulating the signal on different carrier frequencies, or by using a pulsed signal to indicate that a new speaker is talking. Furthermore, this may be also be implemented on multiple channels by the provision of more than one output wire.

Moreover, it is also possible to contemplate implementing an encoding by employing a pulsed signal instead of a DC bias, carrier frequency or two wires. Thus, in essence, rather than using a high or low frequency continually, whenever the microphone detects that someone else besides the user is speaking, this can place an invisible or inaudible "beep" on the line, which can be detected by the decoder, thereby saving battery life.

In essence, any acceptable stereo transmission technique in the art can be readily employing in connection with the foregoing.

In effect, the control of the microphone can be implemented by different methods, such as, through:

1) providing a tactile switch which is controlled by the interviewer or primary speaker, such as a button, trigger or toggle switch located on the microphone;
2) employing an angle sensor in connection with the microphone in order to detect the angular orientation thereof for selecting the voice modulated output;
3) utilizing a frequency detector whereby the interviewer is holding the microphone in order to recognize that it is the interviewer speaking by detecting vibrations in the hand holding the microphone;
4) locating multiple pick-up elements in the head of the microphone in order to detect as to whether the speech is emanating from the interviewer or the interviewee;
5) mounting an inexpensive camera on the microphone to be able to detect the lip motion of the user which can identify the speaker.

The microphone may be adapted to adjust the pick-up elements in any way which produces high-quality separation between the different speech patterns, and the interviewer is trained in the manner as: how to hold the microphone. For example, the components thereof might be angled in 180° opposite directions and tilted 45° from the vertical. The interviewer could then hold the microphone adjusted mostly up and down and with one component of the microphone pointed towards himself (or herself) and the other towards the interviewee, each pick-up element is then adapted in picking up sounds from each speaker, yet a considerable variation will be evident as to who is speaking. Thus, the output of the microphone can be implemented by using a DC bias or multiple wires, utilizing different carrier frequencies, or using any stereo encoding method known in the art.

Basically an advantage resides in that a higher accuracy in the recognition of the speaker in comparison with the current speaker identification technology which uses software can be achieved in a simple manner without requiring continual use or running of the speaker I.D. algorithm, the latter of which introduces a time lag which lengthens the delivery time of; for instance, a multi-language simulcast. Consequently, pursuant to the invention, no training data is required for an interviewer, so as to enable him or her to utilize the microphone practically immediately, such as referred to as "out of the box".

Accordingly, it is an object of the present invention to provide a novel method for providing multiple output channels in a single microphone which enables voice recognition in the use of the microphone by one or more speakers.

Another object of the present invention resides in the provision of an arrangement for providing multiple output channels in a microphone adapted to enable user voice recognition in a simple and expedient manner.

BRIEF DESCRIPTION OF THE ACCOMPANYING DRAWINGS

Reference may now be made to the following detailed description of a preferred embodiment of the invention, taken in conjunction with the accompanying single FIG. 1 of the drawings representing a flowchart in a diagrammatic arrangement for providing multiple output channels in a single microphone.

DETAILED DESCRIPTION OF A PREFERRED EMBODIMENT

Referring to the flowchart 10 illustrated in the drawings, a microphone 12 is represented which receives an audio signal responsive to use thereof by a speaker. The microphone 12 is adapted to an apparatus 14 which determines the identity of the speaker utilizing the microphone, such as a speaker sensor 16, which components may be arranged within the confines of the actual microphone 12.

The microphone 12 may incorporate either a switch 20 which is in the form of a manual switch controlled by the speaker, or the current user of the microphone, or a position switch such as mercury switch which can determine the direction in which the microphone is facing during use thereof; or a sound or other electrical sensor or sensors which is or are arranged in a handle or gripping portion of the microphone, and which can be employed in order to detect when the current holder of the microphone is speaking in contrast with a non-holder of the microphone; or a clip fastened to a lapel on the clothing or located on the body of the speaker, and which is connected to the hand-held microphone through either a thin wire or in a wireless mode. This clip on the speaker may only be required to help detect the holder of the microphone as the person presently speaking, the audio of the small microphone is not used, whereas the hand-held microphone audio is that which is employed.

Upon the sensor 16 determining which of two or more speakers are utilizing the microphone 12, the audio signal 22 captured by the microphone 12 is encoded with a specified speaker indicator number 24 as determined by a speaker sensor in the encoder 26, which is also located in the microphone 12. The most common encoding would be either a high or low frequency bias, whereas another method which employable would be the use of a stereo wire (not shown) with two channels and to encode on different channels; also stereo encoding and possibly employing a pulse.

The encoded signal is received by an audio card, whereupon the original audio signal is extracted and the speaker indicator number 24 decoded in a decoder 28. The speaker indicator number 24 is then available for the particular application which can make use of this in any manner as required, and pursuant to the invention can be employed for different speech recognition models so as to improve the accuracy of a well trained interviewer and of a speaker indicator interviewee.

The foregoing can be also employed in a microphone 12 which encodes the output audio signal 22 so as to provide two or more different channels to afford a choice as to which speech recognition model to employ by either a switch or toggle to select the channel; or a position switch installed in the microphone; or intensity of sound levels are measured via sensors located where the user is holding a microphone.

Installed in or attached to the microphone 12 can also be inexpensive camera 30. This camera is adapted to visually detect lip motion in order to identify the person who is speaking.

In an aspect where an additional clip on the microphone 12 may be positioned on one of the speakers and the output audio signal from the main microphone is encoded with a channel, in the event that the energy of the microphone on the speaker exceeds a threshold, then the encoding may be accomplished by adding a DC bias; or by adding a high frequency overtone; or may be by detecting the encoding in a speech recognizer and using a different speech recording model based on this encoding; where the encoding is recognized by a DC or low-frequency bandpass filter; or where the encoding is recognized by a high-frequency bandpass filter.

Alternatively, the encoding can be implemented by employing a pulsed signal instead of the DC bias, carrier frequency or two wires. Thus, in essence, rather than using a high or low frequency continually, whenever the microphone 12 detects that someone else besides the user is speaking, this can place an invisible or inaudible "beep" on the line, which can be detected by the decoder 28 thereby saving battery life. Hereby, any acceptable stereo transmission technique known in the art can be readily employed in connection with the foregoing.

From the foregoing it becomes readily apparent that the invention clearly eliminates the need for the employing arrangements utilizing multiple microphones or complex software speaker identification modules and systems, and enables a particular multiple output channel to be provided in a single microphone in a simple and expedient manner at low cost and at a high efficiency in the operation thereof.

While the invention has been particularly shown and described with respect to preferred embodiments thereof, it will be understood by those skilled in the art that the foregoing and other changes in form and details may be made therein without departing from the spirit and scope of the invention.

What is Claimed is:

1. A microphone including an arrangement facilitating the reception and identification of at least one speaker utilizing the microphone, said arrangement comprising:

a device for producing an audio signal from said microphone, said audio signal device producing one or more output audio streams in dependence upon the identity of the speaker using the microphone, said microphone comprising at least one switch actuatable by a speaker for producing said one or more output audio streams;

at least one sensor for determining the speaker using said microphone;

an encoder for encoding the audio signal with a speaker with a speaker indicator number as determined by said at least one sensor;

and a decoder for extracting the audio signal and decoding the speaker indicator number so as to enable the deriving of a speaker recognition model determination of the speaker.

2. A microphone as claimed in claim 1, wherein said at last one sensor, said encoder and audio signal producing device are installed in said microphone.

3. A microphone as claimed in claim 1, wherein said at least one sensor determines which of at least two speakers is using the microphone.

4. A microphone as claimed in claim 1, wherein said switch comprises a manually-operated button on said microphone.

5. A microphone as claimed in claim 1, wherein said switch comprises a position switch for detecting an angular orientation of said microphone.

6. A microphone as claimed in claim 5, wherein said position switch comprises a mercury balance switch.

7. A microphone as claimed in claim 1, wherein a plurality of microphone pick-up elements are located in said microphone to enable energy and/or volume levels of said output audio streams to facilitate recognition of the speaker identity.

8. A microphone as claimed in claim 1, wherein sound or electrical sensors arranged in a handle of said microphone detect when a holder of the microphone is speaking in contrast with a non-holder of the microphone.

9. A microphone as claimed in claim 1, wherein said encoder encodes said audio signals through selectively a high- or low-frequency bias.

10. A microphone as claimed in claim 9, wherein said decoder recognizes and eliminates said bias through selectively a DC high-pass or low-pass filter.

11. A microphone as claimed in claim 1, wherein said encoder encodes said output audio signal streams in a plurality of channels by selectively utilizing multiple output wires, adding a DC-bias, modulation on different carrier frequencies, or stereo transmission.

12. A microphone as claimed in claim 11, wherein an auxiliary clip-on microphone device is located on at least one speaker, and the output of the audio signals from the microphone is encoded with one said channel upon the energy of the clip-on microphone device exceeding a predetermined audio threshold.

13. A microphone as claimed in claim 1, wherein said encoder encodes said audio signals by a pulsed signal whereby upon said microphone detecting another speaker, a beep is transmitted for detection by the decoder.

14. A microphone as claimed in claim 1, wherein a speech recognizer detects the encoding of the audio signals in said encoder and utilizes a different speech recognitions model based on the encoding to identify a speaker.

15. A microphone as claimed in claim 1, wherein said microphone includes a camera for ascertaining visually any lip motion so as to detect the identify of the speaker.

16. A method of utilizing a microphone including an arrangement facilitating the reception and identification of at least one speaker utilizing the microphone, said method comprising:

providing a device for producing an audio signal from said microphone, said audio signal device producing one or more output audio streams in dependence upon the identity of the speaker using the microphone, said microphone comprising at least one switch actuatable by a speaker for producing said one or more output audio streams;

providing at least one sensor for determining the speaker using said microphone;

providing an encoder for encoding the audio signal with a speaker with a speaker indicator number as determined by said at least one sensor;

and providing a decoder for extracting the audio signal and decoding the speaker indicator number so as to enable the deriving of a speaker recognition model determination of the speaker.

17. A method as claimed in claim 16, wherein said at least one sensor, said encoder and audio signal producing device are installed in said microphone.

18. A method as claimed in claim 16, wherein said at least one sensor determines which of at least two speakers is using the microphone.

19. A method as claimed in claim 16, wherein said switch comprises a manually-operated button on said microphone.

20. A method as claimed in claim 16, wherein said switch comprises a position switch for detecting an angular orientation of said microphone.

21. A method as claimed in claim 20, wherein said position switch comprises a mercury balance switch.

22. A method as claimed in claim 16, wherein a plurality of microphone pick-up elements are located in said microphone to enable energy and/or volume levels of said output audio streams to facilitate recognition of the speaker identity.

23. A method as claimed in claim 16, wherein sound or electrical sensors arranged in a handle of said microphone detect when a holder of the microphone is speaking in contrast with a non-holder of the microphone.

24. A method as claimed in claim 16, wherein said encoder encodes said audio signals through selectively a high- or low-frequency bias.

25. A method as claimed in claim 24, wherein said decoder recognizes and eliminates said bias through selectively a DC high-pass or low-pass filter.

26. A method as claimed in claim 16, wherein said encoder encodes said output audio signal streams in a plurality of channels by selectively utilizing multiple output wires, adding a DC-bias, modulation on different carrier frequencies, or stereo transmission.

27. A method as claimed in claim 26, wherein an auxiliary clip-on microphone device is located on at least one speaker, and the output of the audio signals from the microphone is encoded with one said channel upon the energy of the clip-on microphone device exceeding a predetermined audio threshold.

28. A method as claimed in claim 16, wherein said encoder encodes said audio signals by a pulsed signal whereby upon said microphone detecting another speaker, a beep is transmitted for detection by the decoder.

29. A method as claimed in claim 16, wherein a speech recognizer detects the encoding of the audio signals in said encoder and utilizes a different speech recognition model based on the encoding to identify a speaker.

30. A method as claimed in claim 16, wherein said microphone includes a camera for ascertaining visually any lip motion so as to detect the identify of the speaker.

* * * * *

UNITED STATES PATENT AND TRADEMARK OFFICE

CERTIFICATE OF CORRECTION

PATENT NO. : 6,959,095 B2
DATED : October 25, 2005
INVENTOR(S) : Raimo Bakins et al.

It is certified that error appears in the above-identified patent and that said Letters Patent is hereby corrected as shown below:

Column 6,
Lines 59-60, “an angular orientation” should read -- an angular-orientation --.

Column 8,
Line 50, “identify” should read -- identity --.

Signed and Sealed this

Second Day of May, 2006

JON W. DUDAS
*Director of the United States Patent and Trademark Office*